United States Patent [19]

Fissmann et al.

[11] Patent Number: 4,809,922

[45] Date of Patent: Mar. 7, 1989

[54] CLAMPING HEAD FOR WINDING CORES

[75] Inventors: Hans-Joachim Fissmann; Hans Weiss, both of Heidenheim, Fed. Rep. of Germany

[73] Assignee: J. M. Voith GmbH, Heidenheim, Fed. Rep. of Germany

[21] Appl. No.: 126,587

[22] Filed: Nov. 30, 1987

[30] Foreign Application Priority Data

Dec. 3, 1986 [DE] Fed. Rep. of Germany ..... 3641256

[51] Int. Cl.[4] ..... B65H 18/02; B65H 16/02

[52] U.S. Cl. ..... 242/68.3; 279/7; 269/52

[58] Field of Search ..... 242/68.1–68.4; 279/7; 269/47, 48, 51, 52

[56] References Cited

U.S. PATENT DOCUMENTS

| | | | |
|---|---|---|---|
| 1,919,769 | 7/1933 | Brown et al. | 242/68.6 |
| 2,231,140 | 2/1941 | Richardson | 242/68.1 |
| 2,336,161 | 12/1943 | Blanchet | 242/68.6 |
| 4,508,283 | 4/1985 | Beisswanger . | |

FOREIGN PATENT DOCUMENTS

| | | |
|---|---|---|
| 7326402 | 7/1973 | Fed. Rep. of Germany . |
| 7523129 | 11/1975 | Fed. Rep. of Germany . |

*Primary Examiner*—Stanley N. Gilreath
*Assistant Examiner*—Steven M. DuBois
*Attorney, Agent, or Firm*—Albert L. Jeffers; Richard L. Robinson

[57] ABSTRACT

The clamping head features a cylindrical section engaging the winding core with a threading which digs in inside the core and a subsequent collar forming a stop for the end face of the core. To obtain a form fit which spares the core, the threading is fashioned as a round threading.

3 Claims, 1 Drawing Sheet

CLAMPING HEAD FOR WINDING CORES

The invention concerns a clamping head for winding cores on which web type material, such as paper webs or the like, is wound, with a cylindrical section engaging the core, with a collar forming a stop for the core end face, and with a threading arranged on the circumference of the cylindrical section.

A previous clamping head is known from GE-GM No. 73 26 402. The cylindrical section of the clamping head, which engagingly fits the core, is provided with a thread of triangular cross-section which, as the clamping head is screwed into the core, slashes the internal layers of the core, which normally consists of wound cardboard. Therefore, a tight fit of the clamping head is not guaranteed, since the slashed layers may be sheared off at high torques between the head and the core.

The U.S. patent document No. 2 231 140 shows a clamping head with a conical section supporting several threads with teeth which have a triangular cross-section. On their end away from the collar of the clamping head, these teeth are terminated at a right angle to the core axis. As the head is screwed into the core, the internal cardboard layers are not only slashed by the pointed teeth but are also cut up by the ends of the teeth. Besides, the conical shape of the clamping head component inserted in the core causes a heavy core deformation, without safeguarding a centering.

Clamping heads for modern winders, for instance according to the German patent document No. 32 43 994, must meet the following requirements: The overall length of the clamping head must be short in order to make the moving distance of the head small, for insertion into and retraction from the core. This affects the time needed for a core change and the width of the rolls that can be produced on the winder. Additionally, the clamping head must be able to carry part of the high roll weight without destruction of the core, as the line pressure of the roll being wound is reduced on the machine rolls supporting the paper roll, for influencing the roll hardness. In the process, the roll being wound must not sag. Lastly, a sliding of the roll being wound must safely be avoided on the clamping head when complete agreement is demanded between the rotation of the core with the material wound onto or unwound from it and the clamping head, due to deriving a measuring signal from the latter. This is a prerequisite, e.g., for the accurate determination of the length of the web material wound onto the core or unwound from it, or for controlling the winding hardness of the material.

The problem underlying the invention is to provide a clamping head which extensively spares the inner layers of the cardboard cores as it is screwed in or removed, in contrast to the initially mentioned prior art.

This problem is solved by the features of the present invention.

The solution has the following advantages: Injury to the core is avoided since the round thread is being jammed into the cardboard layers without slashing them. The screw-in action into the core is facilitated by the thread shape, with the inner cardboard layers undergoing a relatively sparing deformation by the steadily increasing thread.

The problem is solved also by additional features of the present invention, particularly by conical turning of a customarily made round thread. This solution achieves the same, above-mentioned advantages, and additionally, the thread shape can be more easily produced.

According to a further development of the invention, the edges of the thread are suitably rounded in the area of incomplete shaping.

Embodiments of the invention will be more fully explained hereafter with the aid of the drawing.

Figure 1:
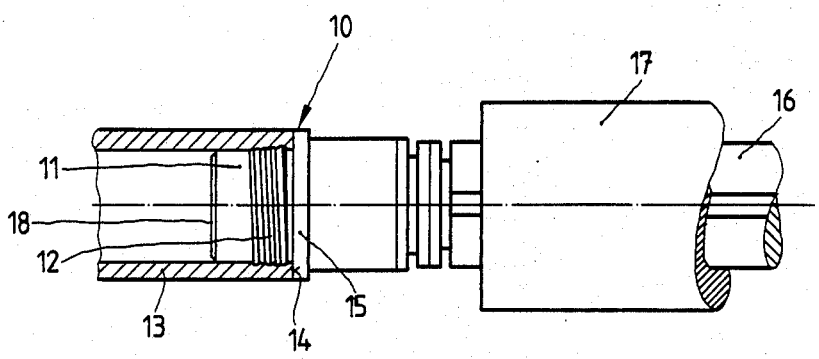
FIG. 1 shows a side elevation of a clamping head screwed into a winding core.
Figure 2:
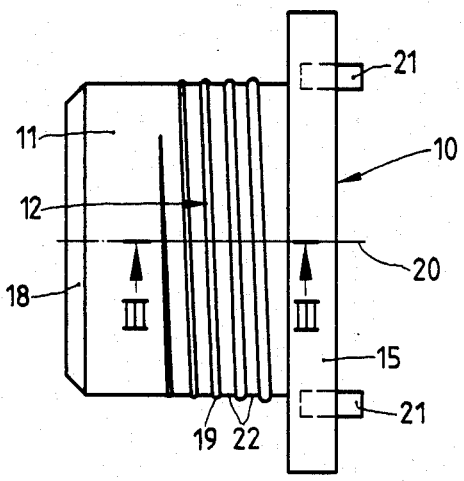
FIG. 2 shows an enlarged illustration of the clamping head according to FIG. 1, with a cylindrical section supporting a conical round thread.

The clamping head 10 with its cylindrical section 11 and a threading 12 molded on it, engagingly fits a winding core 13 which with its end face 14 bears on a collar 15 of the clamping head (FIGS. 1 and 2). The clamping head 10 is rotatably mounted on a spindle 16 which extends through a spindle guide 17 in axially shiftable fashion. Such clamping heads 10 are arranged on both ends of the core 13. The cylindrical section 11, matched to the inside diameter of the core 13, effects the centering of the core. Provided with a bevel 18 to facilitate the introduction of the clamping head 10 into the core 13, the section 11 supports additionally a considerable part of the weight of the core with the material wound onto it.

The collar 15 serves to secure the axial position of the core 13. Interacting with the threading 12, whose thread 19 has dug into the core 13, the collar 15 secures the core against sliding on the clamping head 10 during the winding operation.

The collar 15 features two pin-shaped drivers 21, which are arranged parallel with the clamping head axis 20, for transmission of torques. Such torques must be applied for screwing the clamping head 10 into the core 13 or out of it. For that purpose, the clamping head 10 can be connected to a drive device (not illustrated). As the core 13 or the roll being wound and containing the core is circumferentially driven during winding, the drive device is disengaged from the clamping head 10. In the central drive mode of the core 13 the above drive device can be utilized both for screwing the clamping head 10 into and out of the core, and also for rotationally moving the core 13 or the roll being wound. By way of the drivers 21 it is possible also to apply a braking torque when the web type material wound on the core 13 is to be unwound at a certain web tension in an unwinding station.

The core 13 is made from cardboard layers which are sensitive to injury. To avoid a slashing of these cardboard layers, the threading 12 of the clamping head 10 is fashioned as a round threading. Therefore, the thread 19 has no sharp edges which might act as a cutting edge on the cardboard layers of the core 13. The thread spaces 22 situated between the individual turns of the thread 19 have a diameter equal to that of the cylindrical section 11. In addition to the thread spaces 22, also the thread 19 of section 12 supports a share of the weight of the core 13 and the material contained on it.

Figure 3:
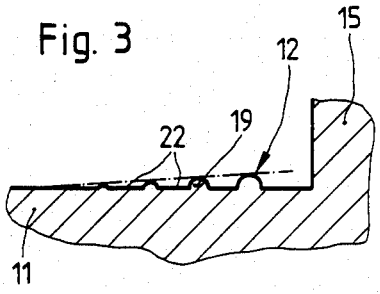
FIG. 3 shows a cross-section along line III—III in FIG. 2, scaled up, of an area of the clamping head in one embodiment of the thread design.

The profile of the threading 12 illustrated as a first embodiment in FIG. 3 has the same shaft diameter as the cylindrical section 11. Originating from the latter, the thread 19 begins with a small profile cross-section and ends at unchanged pitch under steady enlargement of the cross-section on the collar 15 with a geometrically similar cross-section. Thus derived is a round thread profile with a conic definition such as indicated by the broken line in FIG. 3. Extending in cross-section parallel with the clamping head axis 20, the threading spaces 22 become smaller in width in contingence on the cross-section enlargement of the thread 19.

Figure 4:
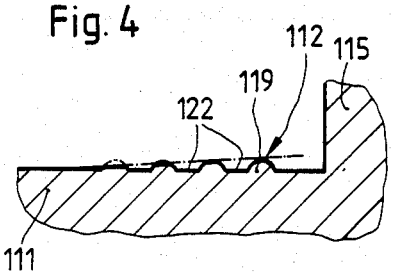
FIG. 4 shows a cross-section according to FIG. 3 with a thread design concerning another embodiment.

Illustrated as the second embodiment in FIG. 4, the profile of the threading 112 is based on a round threading with a cylindrical basic shape which has a shaft diameter that is equal to the diameter of the cylindrical section 111 and has thread spaces 122 with a definition which is parallel with the clamping head axis 20. Basing on this diameter, the threading has a design which conically increases in size toward the collar 115. This thread profile can be achieved by conic turning of a thread 119 formed with a full cross-section (as indicated by broken lines). The sharp edges of the thread 119 caused thereby ca be rounded retroactively. Starting from the cylindrical section 111, the thread 119 begins this way with a foot formation and ends fully formed in the area of the collar 115.

The clamping head 10 can be equipped with a right-hand or left-hand threading. The choice of thread direction depends on the effective direction of the torques to be transmitted by the clamping head 10 to the core 13 and vice versa. The thread direction should be so selected that these torques will increase the prestress force between the clamping head 10 and the core 13 so as to increase the friction moment between the core end face 14 and the collar 15.

What is claimed is:

1. A clamping head for a winding core on which web type material is wound, with a cylindrical section engaging the core, with a collar forming a stop for the core end face, and with a helical threading arranged on the cylindrical section, the improvement in combination therewith comprising:

the helical threading being a round thread originating from the cylindrical section which, in a direction toward the collar, begins with a small profile cross-section and ends with an enlarged, geometrically similar profile cross-section.

2. A clamping head for a winding core on which web type material is wound, with a cylindrical section engaging the core, with a collar forming a stop for the core end face, and with a helical threading arranged on the cylindrical section, the improvement in combination therewith comprising:

the helical threading being a thread commencing from the cylindrical section as an incompletely-shaped round thread with a profile cross-section which increases conically toward the collar to a fully-shaped round thread.

3. A clamping head according to claim 2, in which the incompletely-shaped round thread has rounded edges.

* * * * *